US005360108A

United States Patent [19]

Alagia

[11] Patent Number: 5,360,108

[45] Date of Patent: Nov. 1, 1994

[54] ELECTRONIC DEVICE SHOCK ABSORBER

[75] Inventor: Giovanni Palma Alagia, Agropoli, Italy

[73] Assignee: SEDI S.R.L., Italy

[21] Appl. No.: 110,954

[22] Filed: Aug. 24, 1993

[51] Int. Cl.[5] ..... B65D 81/16

[52] U.S. Cl. ..... 206/320; 206/591

[58] Field of Search ..... 206/305, 320, 328, 521, 206/523, 587, 591; 248/346

[56] References Cited

U.S. PATENT DOCUMENTS

| | | | |
|---|---|---|---|
| 4,071,065 | 1/1978 | Halbich | 206/320 |
| 4,515,272 | 5/1985 | Newhouse | 206/591 |
| 4,703,161 | 10/1987 | McLean | 206/523 |
| 4,733,776 | 3/1988 | Ward | 206/305 |
| 4,739,897 | 4/1988 | Butler | 206/320 |
| 4,762,227 | 8/1988 | Patterson | 206/320 |
| 4,824,059 | 4/1989 | Butler | 206/320 |
| 4,836,256 | 6/1989 | Meliconi | 206/305 |
| 4,901,852 | 2/1990 | King | 206/320 |
| 4,925,149 | 5/1990 | DiFrancesca et al. | 206/320 |
| 5,092,459 | 3/1992 | Uljanic et al. | 206/320 |

FOREIGN PATENT DOCUMENTS

| | | |
|---|---|---|
| 4886 | 8/1993 | Dominican Rep. . |
| 92/07372 | 4/1992 | WIPO . |

OTHER PUBLICATIONS

Communication in European Patent Application No. 91830410.6 (mailed Jun. 9, 1993).

*Primary Examiner*—Jimmy G. Foster

*Attorney, Agent, or Firm*—Wigman, Cohen, Leitner & Myers

[57] ABSTRACT

A housing for protecting hand held electronic devices having buttons or controls thereon from damage due to impacts or falls. The housing is made of an elastomer, preferably polyurethane, PVC, or latex, and having a shore number in the range of A10–A30 shores, which is flexible and stretchable to substantially three times its normal size. The housing has a base and four sides, wherein two of the four sides are substantially long and parallel to each other, and the other two of the four sides are substantially shorter than the long sides and parallel to each other as well. On at least one of the substantially shorter sides, there is located a transverse slot of a predetermined length for passage of signals from the electronic device to a receptor if needed. On at least one of the two long parallel sides there is located a transverse groove of predetermined length. A multiplicity of cylindrical projections are located on one side of the base and integral with the base. The projections are approximately 1 mm in length each. A substantially semi-cylindrical flange-like protection border is provided integral with the surface of the four sides. The sides further define an opening for insertion of the electronic device into the housing as well as for access to the buttons or controls. Due to the resiliency of the material, the housing can be used to encase electronic devices up to three times the original size of the housing while protecting the electronic device from damage due to impacts or falls while still allowing access to the buttons or controls located thereon.

6 Claims, 2 Drawing Sheets

ELECTRONIC DEVICE SHOCK ABSORBER

FIELD OF INVENTION

This invention relates to protectors for electronic devices or the like from damage due to accidental falls or blows inflicted thereon.

BACKGROUND OF THE INVENTION

There exists numerous remote control electronic devices of various sizes, which due to their internal constitutions, may suffer damage if the device falls or is hit against since the shock is absorbed completely by the device. Due to the damages incurred, the majority of the cases, the user is obliged to buy a new device to substitute for the damaged one, usually paying a relatively high price.

U.S. Pat. No. 4,836,256 purports to teach a shock-proof protective sheath for remote controls where the sheath matches the external shape of the remote control it encompasses. The sheath appears to fit only one size of remote control, thus, it appears that one would have to purchase sheaths of different sizes to accommodate different sized remote controls.

PCT publication WO 92/07372 purports to teach a protective jacket for remote control devices where all the walls are made up of thick sections of an elastically extendable material intercalated with thin sections of elastically extendable material to allow the jacket to conform to different sized remote control devices. The protective jacket, specifically the intercalating of the thick sections with the thin sections, may become damaged or may fall due to the thin sections possibly tearing due to a concentrated force thereon.

Applicant has found that a protective housing for various sized hand held electronic devices can be made without the need to have thick sections Intercalated with thin sections throughout the entire device, while still maintaining a high degree of elasticity of the protective housing to conform to various sized hand held devices.

Therefore, it is an object of the invention to provide a protective housing for hand held electronic devices which will protect the device from damage due to falls or blows inflicted thereon by absorbing the shock of the fall or hit thereto.

It is another object of the present invention to provide a protective housing for hand held electronic devices which will conform to various sized devices without loosing the protective properties thereof.

It is yet another object of the invention to provide a protective housing for hand held devices which can be fabricated in any colour, to conform to its surroundings, which includes being opaque, translucent, or transparent.

Further objects of the present invention will become apparent upon reading the following summary of the invention.

SUMMARY OF THE INVENTION

In one embodiment of the invention, there is provided a housing for protecting hand held electronic devices or the like having buttons or controls thereon from damage due to impacts or falls, the housing being made of an elastomer or the like, preferably polyurethane, PVC, or latex, preferably having a shore number substantially in the range of A10–A30 shores, which is flexible and stretchable to at least substantially three times its normal size, comprising a base, and four sides, wherein two of the four sides are substantially long and parallel to each other, and the other two of the four sides are substantially shorter than the other two sides and parallel to each other as well, whereon at least one side of the substantially shorter sides, presents a transverse slot of predetermined length for passage of signals from the electronic device to a receptor if needed, and at least one of the two substantially long parallel sides presents a transverse groove of predetermined length along the length thereof, wherein one side of the base, presents on the surface thereof, a multiplicity of spaced small cylindrical projections integral with said base preferably in a predetermined pattern, 1 mm in length each, wherein the surface of the four sides thereof presents a substantially semi-cylindrical flange protective border integral with said sides, where said sides further define an opening therebetween for insertion of the electronic device into said housing as well as for access to the buttons or controls thereon, while still retaining said electronic device in said housing, such that due to the resiliency of the material, the housing can be used to encase electronic devices up to at least three times the original size of said housing whilst protecting the electronic device from damage due to impacts or falls while still allowing access to the buttons or controls thereon.

In a further embodiment of the invention the dimensions of said housing in an unexpanded form is substantially 140 mm in length, 68 mm in width and 27.5 mm in overall height.

In yet a further embodiment of the invention, the housing is coloured, opaque, transparent or translucent.

BRIEF DESCRIPTION OF THE DRAWINGS

The invention will now be illustrated with respect to the following drawings illustrating embodiments of the invention in which.

DETAILED DESCRIPTION OF PREFERRED EMBODIMENTS OF THE INVENTION

Figure 1:
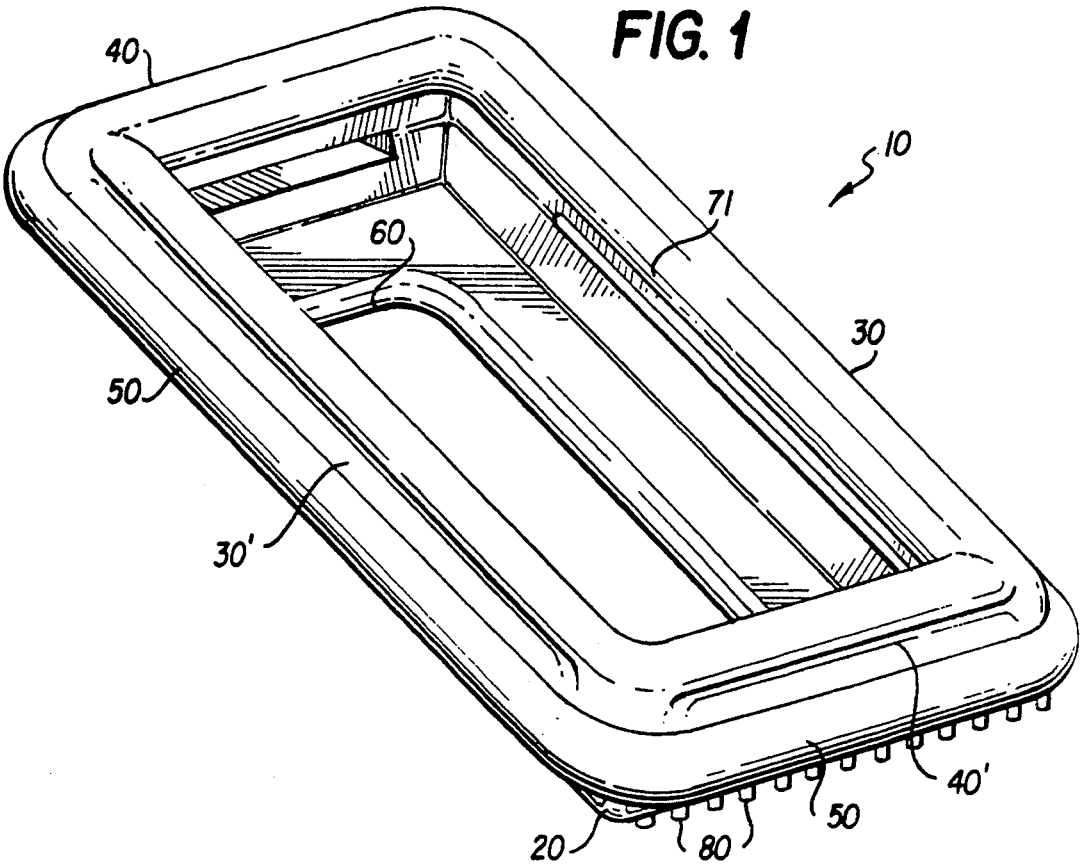
FIG. 1 is a perspective view of the invention in a preferred embodiment.
Figure 4:
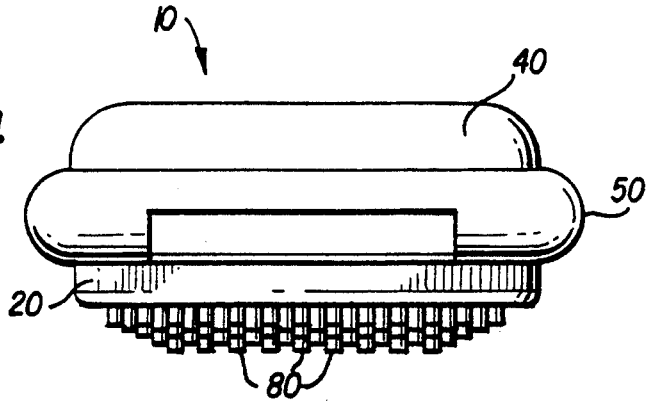
FIG. 4 is an end view of the invention taken along the short end thereof in a preferred embodiment.
Figure 2:
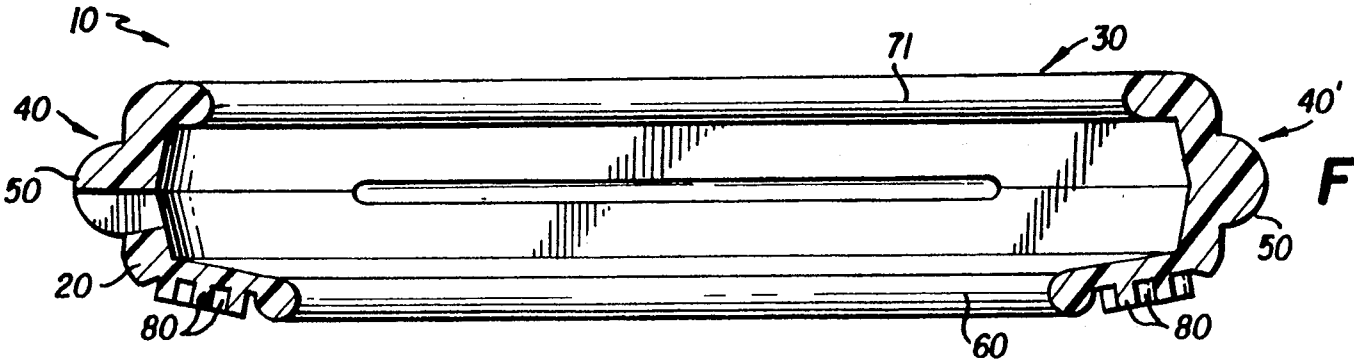
FIG. 2 is a cross sectional view of the invention taken along the long side thereof in a preferred embodiment.
Figure 3:
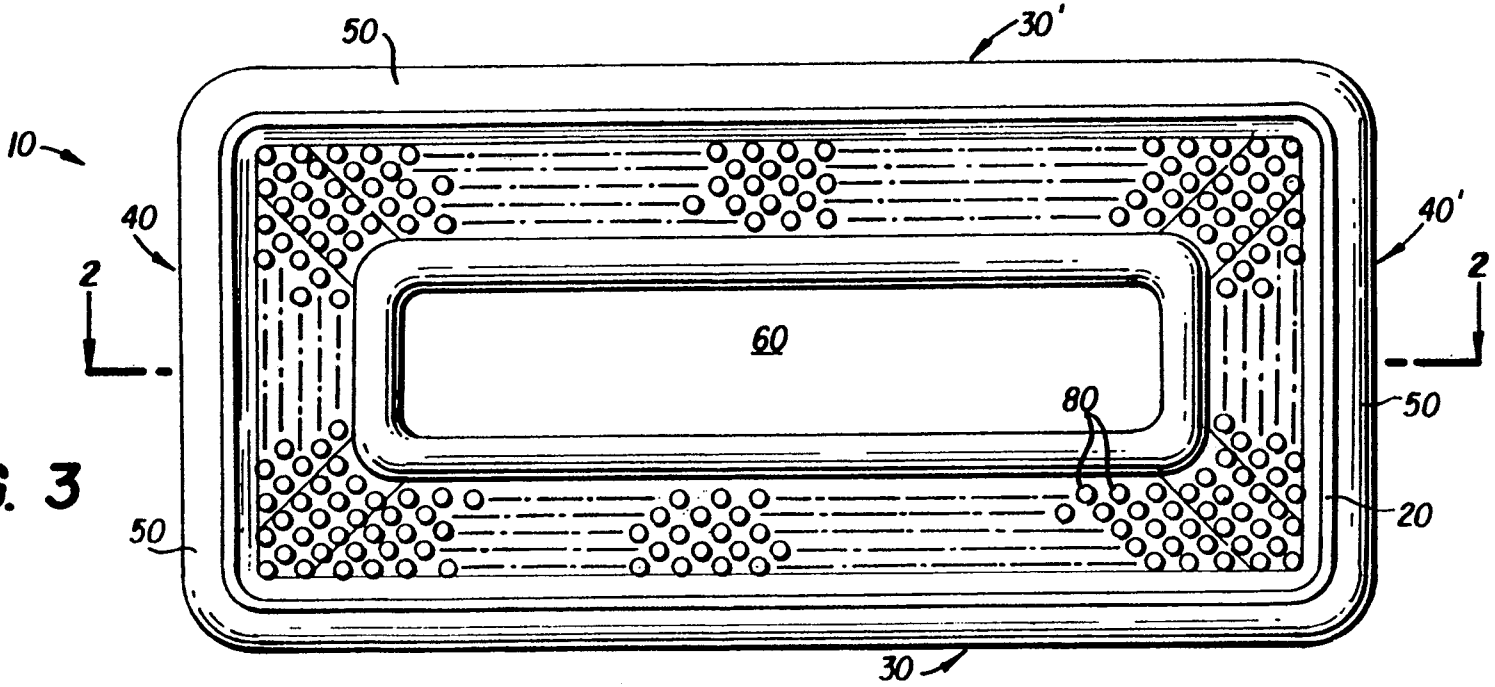
FIG. 3 is a bottom view of the invention in a preferred embodiment.

Referring now to the Figures, there is seen the protective housing generally designated as 10 manufactured by injection molding. The housing 10 has a base 20 and two substantially parallel long sides 30 and 30' and two substantially parallel sides 40 and 40', which define an opening 70, with a retaining lip 71 which a remote control device (not shown) can be inserted into and retained as well. Along the periphery of the sides 30, 30', 40, 40', there is a semi-cylindrical flange like protection shock border 50 integral with said housing 10. The base 20 has a centrally located aperture 60 which serves to aid in the elasticity of the housing 10, particularly the base 20. On the bottom side of base 20, as best seen in FIGS. 2, 3 and 4, there are a multiplicity of spaced apart cylinder like projections 80 1 mm in length, and preferably 384 cylinder like projections, extending substantially normal to said base 20 and integral with said base 20, to absorb any shock to the base 20 area as well as aid in the elasticity of said base 20, and also serves as a friction surface to aid the housing from sliding off a table or any surface. Referring now to FIGS. 1, 2, and 4, on end 40, there is a transverse slot 90 to allow any signals to be emitted or received by the remote control device or any other device if necessary, once inserted into the housing 10. To aid in the expansion of the housing 10 lengthwise and in height, along the inside of the housing 10, specifically on the inside surface of the long sides 30 and 30', there is located a longitudinal groove 100 running the length of each side 30, 30' a predetermined distance. The preferred material of manufacture is an elastomer which exhibits a shore hardness number in the range of substantially A10–A30 shores.

As many changes can be made to the preferred embodiments of the invention without departing from the scope of the invention; it is intended that all material contained herein be interpreted as illustrative of the invention and not in a limiting sense.

The embodiments of the invention in which an exclusive property or privilege is claimed are as follows:

1. A housing for protecting hand held electronic device having buttons or controls thereon from damage due to the impacts or falls, the housing being made of an elastomer which is flexible and stretchable to at least substantially three times its normal size, comprising a base, and four sides, wherein two of the four sides are substantially long and parallel to each other, and the other two sides are substantially shorter than the two long sides and parallel to each other as well, wherein at least one side of the substantially shorter sides, presents a transverse slot of predetermined length for passage of signals from the electronic device to a receptor if needed, and at least one of the two substantially long parallel sides presents a transverse groove of predetermined length along the length thereof, wherein one side of the base, presents on the surface thereof, a multiplicity of spaced small cylindrical projections integral with said base in a predetermined pattern, wherein the surface of the four sides thereof presents a substantially semi-cylindrical flange protective border integral with said sides, where said sides further define an opening therebetween for insertion of the electronic device into said housing as well as for access to the buttons or controls thereon, while still retaining said electronic device in said housing, such that due to the resiliency of the material, the housing can be used to encase electronic devices up to at least three times the original size of said housing whilst protecting the electronic device from damage due to impacts or falls while still allowing access to the buttons or controls thereon.

2. The housing of claim 1 wherein the dimensions of said housing in an unstretched form is substantially 140 mm in length, 68 mm in width and 27.5 mm in overall height.

3. The housing of claim 2 wherein said multiplicity of cylinder like projections are 1 mm in length.

4. The housing of claim 1 wherein said multiplicity of cylinder like projections are 1 mm in length.

5. The housing of claim 1 wherein the elastomer is selected from the group of elastomers consisting of polyurethane, PVC, and latex.

6. The housing of claim 5 wherein the elastomer has a shore number substantially in the range of 10–30 shores.

* * * * *